US011059150B2

(12) United States Patent
Fang et al.

(10) Patent No.: US 11,059,150 B2
(45) Date of Patent: Jul. 13, 2021

(54) ELASTIC SELF-LUBRICATING POLISHING TOOL

(71) Applicant: Dongguan Golden Sun Abrasives Co., Ltd., Dongguan (CN)

(72) Inventors: Hong Fang, Dongguan (CN); Zhongchao Nong, Dongguan (CN)

(73) Assignee: Dongguan Golden Sun Abrasives Co., Ltd., Dongguan (CN)

( * ) Notice: Subject to any disclaimer, the term of this patent is extended or adjusted under 35 U.S.C. 154(b) by 27 days.

(21) Appl. No.: 15/674,516

(22) Filed: Aug. 10, 2017

(65) Prior Publication Data

US 2019/0047123 A1 Feb. 14, 2019

(51) Int. Cl.

| | |
|---|---|
| ***B24D 13/18*** | (2006.01) |
| ***B24D 15/04*** | (2006.01) |
| ***B24D 13/14*** | (2006.01) |
| ***B24D 18/00*** | (2006.01) |

(52) U.S. Cl.

CPC ..... *B24D 13/18* (2013.01); *B24D 13/142* (2013.01); *B24D 15/04* (2013.01); *B24D 18/0009* (2013.01); *B24D 18/0072* (2013.01)

(58) Field of Classification Search

CPC ..... B24D 13/18; B24D 13/142; B24D 15/04; B24D 18/0009; B24D 18/0072; B24D 3/001; B24D 3/005; B24D 3/007; B24D 3/28; B24D 11/001; B24B 37/22; B24B 37/24

USPC ..... 451/488, 527, 528, 530, 533, 539

See application file for complete search history.

(56) References Cited

U.S. PATENT DOCUMENTS 2,922,177 A * 1/1960 Hudson ..... A47L 13/312 401/207
3,883,458 A * 5/1975 Mueller ..... C09D 7/42 106/169.35
4,973,338 A * 11/1990 Gaeta ..... B24D 3/004 51/295
5,250,085 A * 10/1993 Mevissen ..... C09K 3/1409 51/293
5,400,460 A * 3/1995 Roeker ..... B24D 13/14 15/230.12

(Continued)

FOREIGN PATENT DOCUMENTS

CN 105313033 A * 2/2016

OTHER PUBLICATIONS

Translation of CN 105313033, Espacenet, Dec. 31, 2018 (Year: 2018).*

(Continued)

*Primary Examiner* — Orlando E Aviles
*Assistant Examiner* — Thomas Raymond Rodgers
(74) *Attorney, Agent, or Firm* — Raymond Y. Chan; David and Raymond Patent Firm

(57) ABSTRACT

An elastic self-lubricating polishing tool includes an elastic grinding layer including an abrasive member and an elastic base layer affixed to the abrasive member, an absorbing layer absorbing and sustainedly releasing liquid inside of the absorbing layer, and an adhesive layer overlappedly connected with the elastic base layer of the elastic grinding layer and the absorbing layer. The elastic self-lubricating polishing tool is elastic and self-lubricating to sand and polish a surface of a workpiece.

3 Claims, 7 Drawing Sheets

(56) References Cited

U.S. PATENT DOCUMENTS 5,490,878 A * 2/1996 Peterson ..... B24D 3/28 51/295
5,594,061 A * 1/1997 Sharma ..... C08J 7/047 524/155
5,975,988 A * 11/1999 Christianson ..... B24D 3/002 451/28
6,019,805 A * 2/2000 Herron ..... A46D 1/00 51/293
6,299,521 B1 * 10/2001 Morimura ..... B24D 3/28 451/533
7,118,469 B1 * 10/2006 Lee ..... B24D 11/001 451/527
2003/0143938 A1 * 7/2003 Braunschweig ..... B24D 11/02 451/533
2005/0055885 A1 * 3/2005 Obeng ..... B24D 3/26 51/293
2007/0066185 A1 * 3/2007 Felipe, Sr. ..... B24B 7/20 451/41
2007/0066198 A1 * 3/2007 Rambosek ..... B01D 46/10 451/533
2007/0178812 A1 * 8/2007 Shimomura ..... B24B 37/22 451/41
2009/0170413 A1 * 7/2009 Hsu ..... B24B 37/22 451/533
2011/0143618 A1 * 6/2011 Wei ..... C08G 65/485 442/59
2012/0220207 A1 * 8/2012 Dean ..... B24D 11/00 451/490
2015/0183090 A1 * 7/2015 Hsu ..... B24D 18/0072 451/532
2015/0239090 A1 * 8/2015 Guo ..... B24B 37/22 51/298
2016/0059388 A1 * 3/2016 Pray ..... B24D 11/04 451/529
2016/0074998 A1 * 3/2016 Sharmila ..... B24D 11/02 451/532

OTHER PUBLICATIONS

Translation of CN105313033, retrieved from Espacenet on Oct. 23, 2020 (Year: 2016).*

* cited by examiner

ELASTIC SELF-LUBRICATING POLISHING TOOL

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a polishing tool, and more particularly to an elastic self-lubricating polishing tool.

Description of Related Arts

In order to finish an outer or inner surface of a workpiece, a sanding and polishing tool is commonly used for sanding and polishing the surface of the workpiece. Those tools may also be used for partially sanding the surface of the workpiece depending on the application thereof. In the areas of automobile manufacturing and repair of cars and precision sanding and polishing of 3C electronic industry, the sanding and polishing tools are commonly used. The sanding and polishing tools are commonly provided for manually finishing the surface of the workpiece so as to increase the quality thereof. Due to the flexibility and simplicity of operating a hand sanding or abrading tool, such as sandpaper or conventional files having variety of cuts or tooth configurations, it is widely applied for finishing or rubbing the workpiece. Although those conventional sanding and polishing tools devices are suitable for a number of applications and whether those devices are used manually or automatically, the conventional sanding and polishing tools for finishing the surface of workpiece manually or automatically are still suffering from many disadvantages such as poor properties of tension, elasticity and so on. On the other hand, even though some conventional sanding and polishing tools are capable of absorbing liquid, the liquid are easily and quickly released from the interior of the conventional sanding and polishing tools. As a result, users have to make the conventional sanding and polishing tools to absorb liquid again in a very short time, resulting in a low efficiency. In addition, some conventional sanding and polishing tools are easy to be worn out and have a short life span resulting in an increased cost.

SUMMARY OF THE PRESENT INVENTION

The invention is advantageous in that it provides an elastic self-lubricating polishing tool, wherein the elastic self-lubricating polishing tool is elastic and self-lubricating to sand and polish a surface of a workpiece.

Another advantage of the invention is to provide an elastic self-lubricating polishing tool, wherein the elastic self-lubricating polishing tool can be used both under dry and wet conditions.

Another advantage of the invention is to provide an elastic self-lubricating polishing tool, wherein the elastic self-lubricating polishing tool has toughness, wear resistance, cold resistance, and good environmental protection non-toxic properties.

Another advantage of the invention is to provide an elastic self-lubricating polishing tool, wherein the elastic self-lubricating polishing tool can be made into different shapes and sizes according to different requirements.

Another advantage of the invention is to provide an elastic self-lubricating polishing tool, wherein the elastic self-lubricating polishing tool comprises an elastic grinding layer coated with a lubricating coating made of material having lubricating, anti-static and water resistance properties, so that the elastic self-lubricating polishing tool has a good anti-clogging performance and a life span is extended.

Another advantage of the invention is to provide an elastic self-lubricating polishing tool, wherein the elastic self-lubricating polishing tool comprises an absorbing layer which is made of polymer material by a foaming process and has characteristics of absorbing and sustained releasing lubricating liquid or cooling liquid, so that the absorbing layer has effects of cooling, lubricating and anti-blocking during a sanding and polishing process of the elastic self-lubricating polishing tool.

Another advantage of the invention is to provide an elastic self-lubricating polishing tool, wherein the elastic self-lubricating polishing tool comprises an adhesive layer affixed the elastic grinding layer to the absorbing layer, so that the elastic self-lubricating polishing tool has a stable connection without weaken the properties of elastic, self-lubricating and absorbing ability.

Another advantage of the invention is to provide an elastic self-lubricating polishing tool, wherein the elastic self-lubricating polishing tool is durable and economical for users.

Additional advantages and features of the invention will become apparent from the description which follows, and may be realized by means of the instrumentalities and combinations particular point out in the appended claims.

According to the present invention, the foregoing and other objects and advantages are attained by an elastic self-lubricating polishing tool, comprising:

an elastic grinding layer comprising an abrasive member and an elastic base layer affixed to the abrasive member, an absorbing layer absorbing and sustained releasing liquid inside of the absorbing layer, and an adhesive layer overlappedly connected with the elastic base layer of the elastic grinding layer and the absorbing layer.

According to the present invention, the foregoing and other objects and advantages are also attained by a method of manufacturing an elastic self-lubricating polishing tool comprises the following steps of:

(a) attaching an abrasive member to an elastic base layer to form an elastic grinding layer of the elastic self-lubricating polishing tool;

(b) coating the elastic grinding layer with a lubricating coating; and (c) overlappedly attaching the elastic grinding layer to one side of an absorbing layer by an adhesive layer.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 7 of the drawings, an elastic self-lubricating polishing tool according to a preferred embodiment is illustrated, wherein the elastic self-lubricating polishing tool comprises an elastic grinding layer 10, an absorbing layer 20, an adhesive layer 30 and an outer flannelette layer 40.

Figure 1:
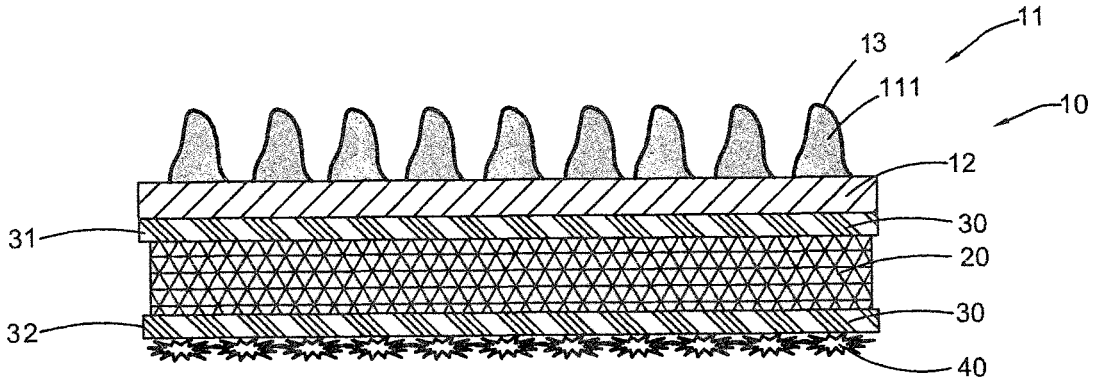
FIG. 1 is a perspective view of an elastic self-lubricating polishing tool according to a preferred embodiment of the present invention.

The elastic self-lubricating polishing tool has a laminated composite configuration formed by the elastic grinding layer 10, the absorbing layer 20, the adhesive layer 30 and the outer flannelette layer 40. The elastic grinding layer 10, the absorbing layer 20 and the outer flannelette layer 40 are affixed by the adhesive layer 30. In other words, the adhesive layer 30 is overlappedly connected with the elastic grinding layer 10, the absorbing layer 20 and the outer flannelette layer 40. Specifically, as shown in FIG. 1 according to the preferred embodiment of the present invention, the adhesive layer 30 further comprises a first adhesive layer 31 and a second adhesive layer 32. The elastic grinding layer 10 is overlappedly affixed to one side portion of the absorbing layer 20 by the first adhesive layer 31 and the outer flannelette layer 40 is overlappedly affixed to other side portion of the absorbing layer 20 by the second adhesive layer 32. Accordingly, the elastic grinding layer 10, the absorbing layer 20, the adhesive layer 30 and the outer flannelette layer 40 form the laminated composite configuration of the elastic self-lubricating polishing tool.

Figure 2:
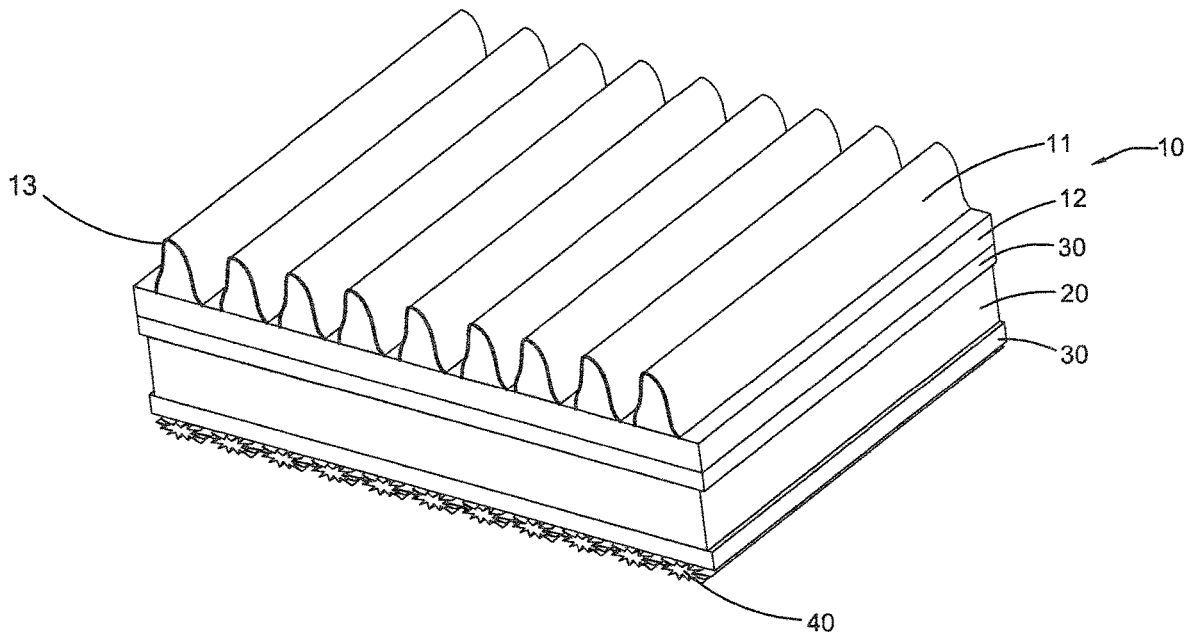
FIG. 2 is a perspective view of the elastic self-lubricating polishing tool according to above preferred embodiment of the present invention.
Figure 3:
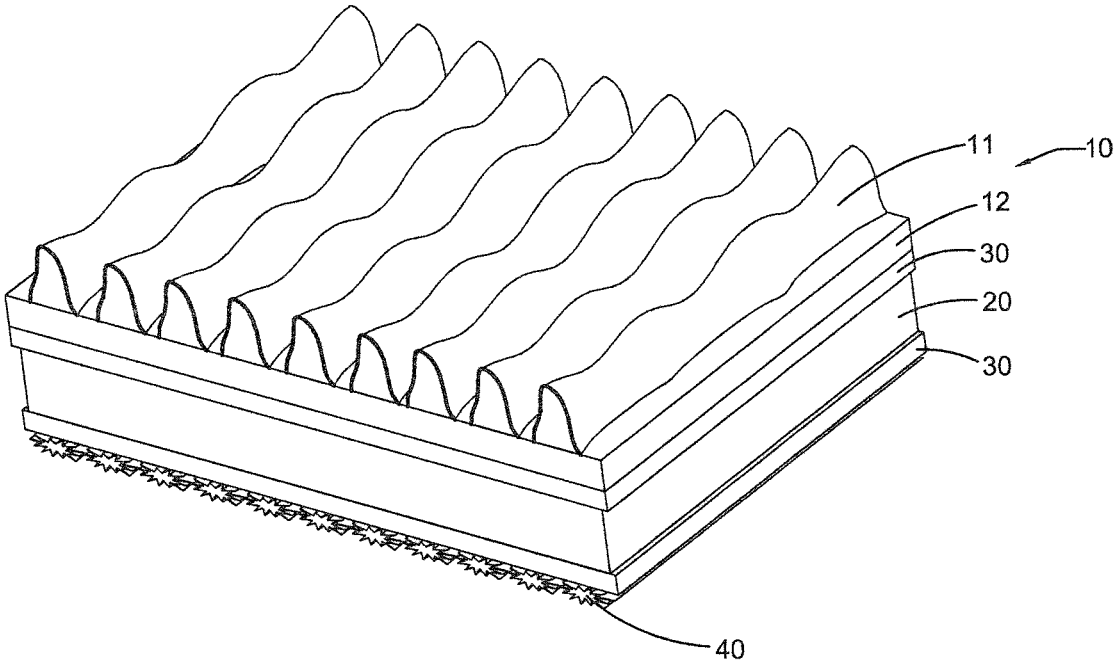
FIG. 3 is a perspective view of an elastic self-lubricating polishing tool according to an alternative mode of the present invention.
Figure 4:
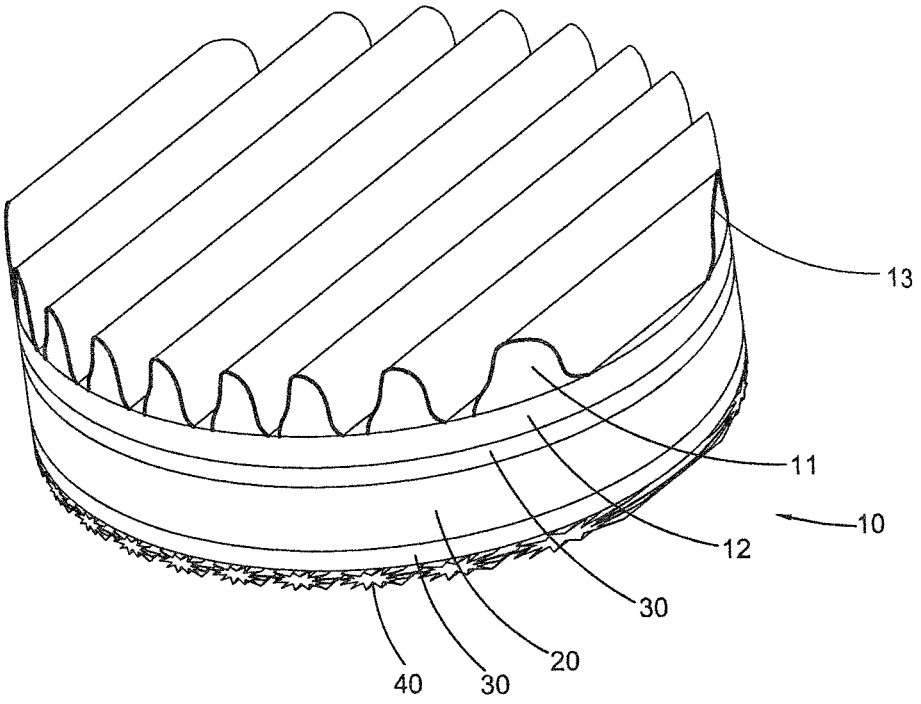
FIG. 4 is a perspective view of an elastic self-lubricating polishing tool according to an alternative mode of the present invention.

It is worth mentioning that the elastic self-lubricating polishing tool is cut and made into different shapes and sizes according to different requirements. As shown in FIG. 2 to FIG. 4 of the drawings, the elastic self-lubricating polishing tool is made into square, disc-shaped and so on after a back-coating process and a punching process. The elastic self-lubricating polishing tool is provided for manually polishing a surface of a workpiece. Users can hold the elastic self-lubricating polishing tool in a manner of palms closely contacting the outer flannelette layer 40 and figures grapping peripheral side portions of the elastic self-lubricating polishing tool to cut and polish the surface of the workpiece using the elastic grinding layer 10. The peripheral side portions of the elastic self-lubricating polishing tool is also manufactured into a shape which conform to the human engineering in such a manner that the comfortable sensation of users during operating process is enhanced and the elastic self-lubricating polishing tool is not easy to be slipped off. It is worth mentioning that the elastic self-lubricating polishing tool is not only used for manually polishing the surface of the workpiece, but also can be assembled with automatic devices to achieve automatically sanding and polishing performance according to other embodiments of the present invention. For example, in some embodiments of the present invention, the elastic self-lubricating polishing tool is assembled with a driving member such as a motor and the elastic grinding layer 10 of the elastic self-lubricating polishing tool is faced outwardly for sanding and polishing the surface of the workpiece automatically. One skilled in the art will understand that the shapes and operation manners of the elastic self-lubricating polishing tool of the embodiments of the present invention described above are exemplary only and not intended to be limiting.

As shown in FIG. 1 of the drawings, the elastic grinding layer 10 further comprises an abrasive member 11 and an elastic base layer 12. The abrasive member 11 is affixed to the elastic base layer 12 for sanding and polishing the surface of the workpiece. The abrasive member 11 further comprises a plurality of abrasive convex pieces 111. Accordingly, the abrasive member 11 has a predetermined length that the plurality of abrasive convex pieces 111 is projected for sanding and polishing against the surface of the workpiece. Specifically, the plurality of abrasive convex pieces 111 is spacedly arranged on an outer side surface of the elastic base layer 12. An inner side of the elastic base layer 12 is overlappedly and closely affixed to the first adhesive layer 31. The plurality of abrasive convex pieces 111 is adapted for directly sanding and polishing the surface of the workpiece. As the plurality of abrasive convex pieces 111 is made of rigid material with a larger hardness than the material of the workpiece, when the plurality of abrasive convex pieces 111 is moved on the surface of the workpiece in a reciprocating way manually or automatically, the surface of the workpiece are rubbed and scrapped to achieve a sanding and polishing performance of the elastic self-lubricating polishing tool.

According to the preferred embodiment of the present invention as shown in FIG. 2, the plurality of abrasive convex pieces 111 is evenly spaced on the elastic base layer 12 and a top edge portion of each of the plurality of abrasive convex pieces 111 is in a same horizontal plane. In this preferred embodiment of the present invention, each of the abrasive convex pieces 111 is elongated and integrally extended from one edge of the elastic base layer 12 to other edge of the elastic base layer 12. As shown in FIG. 3 of the drawings according to another embodiment of the invention, the plurality of abrasive convex pieces 111 is wave-shaped. In other words, the top edge portion of each of the plurality of abrasive convex pieces 111 is not in a same horizontal plane, so that the plurality of abrasive convex pieces 111 can sand and polish a workpiece having an irregular surface. For example, the irregular protrusions of the plurality of abrasive convex pieces 111 can polish a narrow concave portion surface of the workpiece. It is worth mentioning that in other embodiments of the present invention, the plurality of abrasive convex pieces 111 is not elongated and integrally formed, instead, each one of the plurality of abrasive convex pieces 111 is elongated outwardly from the elastic base layer 12 in such a manner that the overall abrasive convex pieces 111 are densely arranged on the elastic base layer 12. In other words, the abrasive convex pieces 111 are arranged in a way which is similar to tooth of a wide-tooth comb or brushing bristles of a toothbrush. One skilled in the art will understand that the shapes and arrangements of the abrasive member 11 of the elastic self-lubricating polishing tool of the embodiments of the present invention described above are exemplary only and not intended to be limiting.

It is worth mentioning that the elastic base layer 12 is a substrate of the elastic grinding layer 10 and is made of elastic material having toughness, wear resistance, cold resistance, and good environmental protection non-toxic properties. Because of the properties of the elastic base layer 12, although there are interaction forces generated between the abrasive member 11 and the elastic base layer 12, the plurality of abrasive convex pieces 111 is not easy be worn off from the elastic base layer 12, so that the elastic self-lubricating polishing tool is durable and economical for users.

More specifically, according to the preferred embodiment of the present invention, the elastic grinding layer 10 further comprises a lubricating coating 13 coated on a surface of the abrasive member 11. The lubricating coating 13 is made of material having lubricating, anti-static and water resistance properties, so that the elastic self-lubricating polishing tool has a good anti-clogging performance and a life span is extended. During an operational process of the elastic self-lubricating polishing tool, there are frictions generated among the plurality of abrasive convex pieces 111 and between the surface of the workpiece and the plurality of abrasive convex pieces 111. The frictions may result in being worn off of the plurality of abrasive convex pieces 111. As the lubricating coating 13 is coated on each of the plurality of abrasive convex pieces 111, the abrasive member 11 is durable and is easy to sand and polish the surface of the workpiece. In addition, as the lubricating property of the lubricating coating 13, the plurality of abrasive convex pieces 111 have a good cooperation to sand and polish the surface of the workpiece and unexpected scratches on the surface of the workpiece are prevented, so that the polishing quality of the surface of the workpiece is increased, thus the elastic self-lubricating polishing tool has a good self-lubricating performance. Furthermore, as the water resistance property of the lubricating coating 13, the elastic self-lubricating polishing tool is particularly adapted for using under a wet grinding condition and has a better effect than under a dry grinding condition. As a result, the elastic self-lubricating polishing tool of the present invention is a kind of sanding and polishing device which are adapted for working in wet or dry process.

Figure 7:
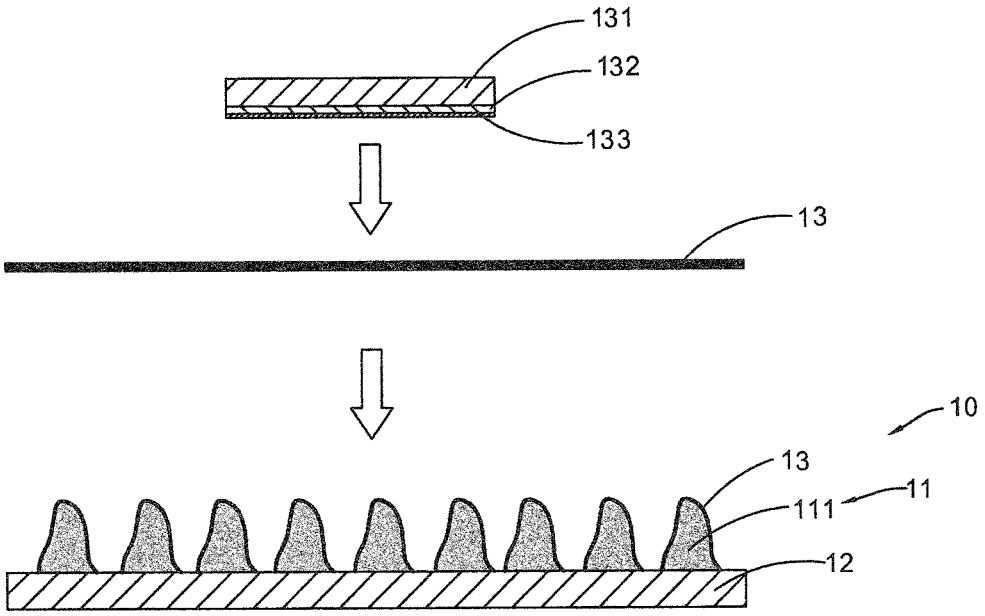
FIG. 7 is a perspective view of an elastic grinding layer of the elastic self-lubricating polishing tool according to above preferred embodiment of the present invention.

More specifically, as shown in FIG. 7, compositions of manufacturing the lubricating coating 13 are a lubricant agent component 131, an adhesive agent component 132 and an antistatic agent component 133. According to the preferred embodiment of the invention, a basic proportion of the lubricant agent component 131, the adhesive agent component 132 and the antistatic agent component 133 by weight is 100:15:8. One skilled in the art will understand that the proportion of compositions of manufacturing the lubricating coating 13 of the embodiments of the present invention described above is exemplary only and not intended to be limiting. In addition, it is understandable that the lubricant agent component 131, the adhesive agent component 132 and the antistatic agent component 133 as shown in FIG. 7 are not structural description. In other words, the manufacturing way of the lubricating coating 13 is not structural overlap the lubricant agent component 131, the adhesive agent component 132 and the antistatic agent component 133 together, instead, in some embodiments, the lubricating coating 13 is made by chemical methods.

As shown in FIG. 7, the lubricating coating 13 is coated on abrasive member 11 and is particularly coated on surfaces of each of the plurality of abrasive convex pieces 111. Furthermore, the lubricating coating 13 can also be coated on a surface of the elastic base layer 12 which are exposed between each two of the plurality of abrasive convex pieces 111.

Figure 5:
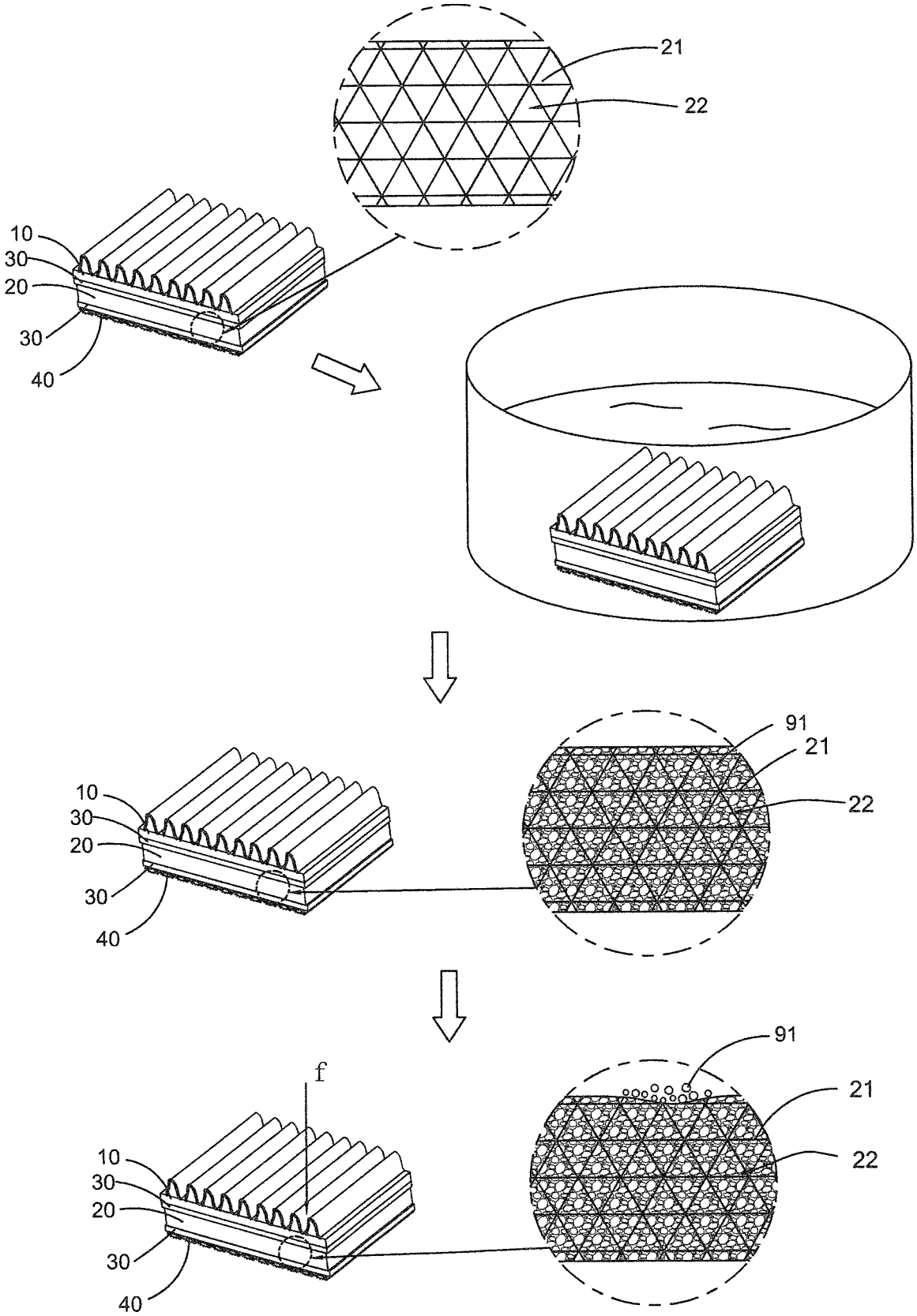
FIG. 5 is a perspective view of the elastic self-lubricating polishing tool according to above preferred embodiment of the present invention.

According to the preferred embodiment of the present invention as shown in FIG. 5, the absorbing layer 20 is made of polymer material by a foaming process and has characteristics of absorbing and sustainedly releasing lubricating liquid or cooling liquid, so that the absorbing layer 20 has effects of cooling, lubricating and anti-blocking during a sanding and polishing process of the elastic self-lubricating polishing tool.

Specifically, the absorbing layer 20 further has a plurality of receiving holes 22 formed by an absorbing layer body 21 of the absorbing layer 20. The receiving holes 22 are densely and numerously arranged inside the absorbing layer body 21. In other words, the absorbing layer body 21 has a plurality of receiving cabins forming the plurality of receiving holes 22. As the absorbing layer 20 is made of polymer material by a foaming process and has characteristics of absorbing and sustainedly releasing lubricating liquid or cooling liquid, when the elastic self-lubricating polishing tool is put into liquid 91, the absorbing layer body 21 is capable of absorbing a relatively large amount of liquid 91. In other words, large amount of liquid 91 such as lubricating liquid or cooling liquid are hold inside the densely and numerously receiving holes 22. When a pressure f is applied on the elastic self-lubricating polishing tool, the liquid 91 inside the densely and numerously receiving holes 22 will be slowly released from the absorbing layer 20 and permeated through the adhesive layer 30 and the elastic grinding layer 10 to play a lubricating or a cooling role, so that the absorbing layer 20 has effects of cooling, lubricating and anti-blocking during a sanding and polishing process of the elastic self-lubricating polishing tool, thereby enhancing a sanding and polishing quality on the surface of the workpiece.

It is worth mentioning that a size and a density of the receiving holes 22 have effects on the absorbing, lubricating and elastic ability of the absorbing layer 20.

Figure 6:
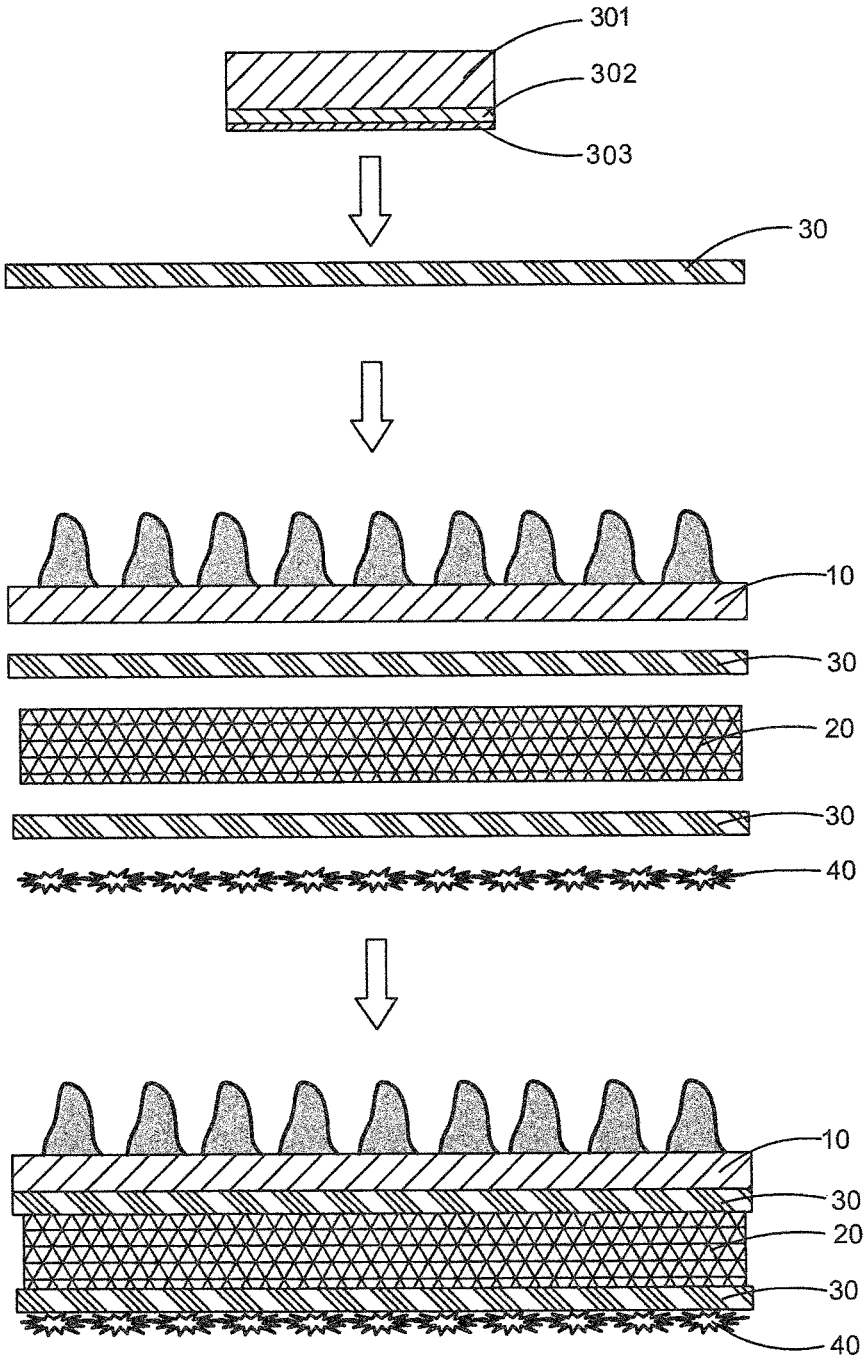
FIG. 6 is a perspective view of the elastic self-lubricating polishing tool according to above preferred embodiment of the present invention.

Furthermore, according to the preferred embodiment of the present invention as shown in FIG. 6, the elastic grinding layer 10, the absorbing layer 20 and the outer flannelette layer 40 are affixed by the adhesive layer 30. As the elastic grinding layer 10 is smooth and soft, when the elastic grinding layer 10 is attached to the absorbing layer 20, the elastic grinding layer 10 is easy to be fold and deformed to have wrinkles. In addition, as the absorbing layer 20 has a good adsorption property, if the elastic grinding layer 10 is attached to one side of the absorbing layer 20 by a conventional liquid adhesive agent, the conventional liquid adhesive agent is easily penetrated into the absorbing layer 20, and if the outer flannelette layer 40 is affixed to other side of the absorbing layer 20 by the conventional liquid adhesive agent, the conventional liquid adhesive agent is also easily penetrated into the absorbing layer 20. As a result, the elastic grinding layer 10 and the outer flannelette layer 40 are to be separated easily from the absorbing layer 20. And even worse, as the conventional liquid adhesive agent is penetrated into the absorbing layer 20, the densely and numerously receiving holes 22 will be filled full of the conventional liquid adhesive agent and the lubricating or cooling liquid cannot be received in the receiving holes 22. In other words, the absorbing layer 20 will lose the property of absorbing and sustainedly releasing.

In order to solve these problems, as shown in FIG. 6 of the drawings according to the preferred embodiment of the present invention, during a method of manufacturing the elastic self-lubricating polishing tool, an adhesive agent combination comprising an amino resin agent component 301, a curing agent component 302 and a flatting agent component 303 is pressed in a predetermined hot-press temperature to form the thin-film-shaped adhesive layer 30. Preferably, on one embodiment of the present invention, the predetermined hot-press temperature value is a range from 70° C.-80° C. A basic proportion of the amino resin agent component 301, the curing agent component 302 and the flatting agent component 303 by weight is 100:10:0.2.

One skilled in the art will understand that the proportion of compositions of manufacturing the adhesive layer 30 of the embodiments of the present invention described above is exemplary only and not intended to be limiting. In addition, it is understandable that the amino resin agent component 301, the curing agent component 302 and the flatting agent component 303 by weight as shown in FIG. 6 are not structural description.

It is worth mentioning that as the properties of the elastic grinding layer 10 and the absorbing layer 20, the elastic self-lubricating polishing tool is a sanding and polishing device having characteristics of superior tension, elasticity, super soft, self-lubricating, anti-blocking and dual-purpose used in both dry and wet environments. The elastic self-lubricating polishing tool is more adapted to be used in wet environments. Furthermore, according to some embodiments of the present invention, the elastic self-lubricating polishing tool can be used in the area of automobile manufacturing and repair of cars, precision sanding and polishing of 3C electronic industry, and the elastic self-lubricating polishing tool is especially suitable for repair of surfaces coating with repair paint and precision polishing of irregular surfaces and curved surfaces.

According to the embodiments of the present invention, a method of manufacturing the elastic self-lubricating polishing tool is also provided, wherein the method of manufacturing the elastic self-lubricating polishing tool comprises the following steps.

(a) attaching the abrasive member 11 having the plurality of abrasive convex pieces 111 to the elastic base layer 12 to form the elastic grinding layer 10.

(b) coating the elastic grinding layer 10 with the lubricating coating 13.

(c) overlappedly attaching the elastic grinding layer 10 to one side of the absorbing layer 20 by the adhesive layer 30.

It is worth mentioning that after the step (c), the method of manufacturing the elastic self-lubricating polishing tool further comprises a step of: overlappedly attaching the outer flannelette layer 40 to other side of the absorbing layer 20 by the adhesive layer 30.

It is worth mentioning that the step (b) further comprises the following step of: providing the lubricant agent component 131, the adhesive agent component 132 and the antistatic agent component 133 to form the lubricating coating 13. Preferably, a basic proportion of the lubricant agent component 131, the adhesive agent component 132 and the antistatic agent component 133 by weight is 100:15:8.

It is worth mentioning that the method of manufacturing the elastic self-lubricating polishing tool further comprises the following steps.

Providing an adhesive agent combination comprising the amino resin agent component 301, the curing agent component 302 and the flatting agent component 303.

Pressing the adhesive agent combination in a hot-press temperature to form the thin-film-shaped adhesive layer 30.

Preferably, on one embodiment of the present invention, the hot-press temperature value is a range from 70° C.-80° C. A basic proportion of the amino resin agent component 301, the curing agent component 302 and the flatting agent component 303 by weight is 100:10:0.2.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing an elastic self-lubricating polishing tool comprises said following steps of:

(a) attaching an abrasive member having a plurality of abrasive convex pieces with wave-shaped top portion to an elastic base layer to form an elastic grinding layer of said elastic self-lubricating polishing tool;

(b) coating a surface of said elastic grinding layer with a lubricating coming by the steps of:

(b.1) coating said lubricating coating on each of said abrasive convex pieces; and (b.2) coating said lubricating coating on said elastic base layer which is exposed between each two of said abrasive convex pieces;

(c) attaching said elastic grinding layer to one side of an absorbing layer by a first adhesive layer to allow liquid inside of said absorbing layer to be released from said absorbing layer and penetrate through said adhesive layer and said elastic base layer of said elastic grinding layer;

(d) attaching an outer flannelette layer to other side of said absorbing layer by a second adhesive layer; and (e) each of said first and second adhesive layers comprising an adhesive agent combination comprising an amino resin agent component, a curing agent component and a flatting agent component, and pressing each of said adhesive agent combination in a hot-press temperature to form respective first and second thin-film- shaped adhesive layer.

2. The method, as recited in claim 1, wherein said hot-press temperature value has a range from 70° C.-80° C.

3. The method, as recited in claim 1, wherein a basic proportion of said amino resin agent component, said curing agent component and said flatting agent component by weight is 100:10:0.2.

* * * * *